US011506022B2

(12) United States Patent
Freire Grandi et al.

(10) Patent No.: US 11,506,022 B2
(45) Date of Patent: Nov. 22, 2022

(54) METHODS FOR WELL CONSTRUCTION AND COMPLETION

(71) Applicant: PETROLEO BRASILEIRO S.A.—PETROBRAS, Rio de Janiero (BR)

(72) Inventors: Ricardo Freire Grandi, Rio de Janeiro (BR); Renan da Silva Costa, Niteroi (BR); Otavio Campos de Araujo, Rio de Janeiro (BR); Leonardo Marazzo Garcia, Rio de Janeiro (BR); Kris Pernasetti Dunlop, Rio de Janeiro (BR); Jose Ricardo Brigido de Moura Filho, Rio de Janeiro (BR); Joao Paulo Sanseverino Abdu, Rio de Janeiro (BR); Joao Marcelo Mussi Baptista, Rio de Janeiro (BR); Gustavo Salgueiro de Oliveira, Rio de Janeiro (BR); Giovani Ferreira Machado, Rio de Janeiro (BR); George Souza Costa, Rio de Janeiro (BR); Frederico Ferreira Chaves Vaz, Rio de Janeiro (BR); Ednaldo Goncalves de Moura, Salvador (BR); Cristiane Koslinski, Rio de Janeiro (BR); Carolina Bertholdo da Cunha, Rio de Janeiro (BR); Aliel Faria Riente, Niteroi (BR); Antonio Carlos Ramos Junior, Rio de Janeiro (BR); Alexandre Campos Manhaes, Rio de Janeiro (BR)

(73) Assignee: PETROLEO BRASILEIRO S.A.—PETROBRAS, Rio de Janiero (BR)

( * ) Notice: Subject to any disclaimer, the term of this patent is extended or adjusted under 35 U.S.C. 154(b) by 116 days.

(21) Appl. No.: 17/044,893

(22) PCT Filed: Apr. 4, 2019

(86) PCT No.: PCT/BR2019/050123
§ 371 (c)(1),
(2) Date: Oct. 2, 2020

(87) PCT Pub. No.: WO2019/191827
PCT Pub. Date: Oct. 10, 2019

(65) Prior Publication Data

US 2021/0148195 A1 May 20, 2021

(30) Foreign Application Priority Data

Apr. 5, 2018 (BR) ..... 10 2018 006864 4

(51) Int. Cl.
*E21B 23/00* (2006.01)
*E21B 23/06* (2006.01)
(Continued)

(52) U.S. Cl.
CPC ..... *E21B 41/0007* (2013.01); *E21B 7/007* (2013.01); *E21B 23/00* (2013.01);
(Continued)

(58) Field of Classification Search
CPC ..... E21B 23/00; E21B 23/06; E21B 33/064; E21B 33/14; E21B 41/0007; E21B 43/10; E21B 47/00; E21B 7/00; E21B 7/007
See application file for complete search history.

(56) References Cited

U.S. PATENT DOCUMENTS 8,122,975 B2 2/2012 Belcher
10,954,762 B2 * 3/2021 Patel ..... E21B 43/08
(Continued)

FOREIGN PATENT DOCUMENTS

BR 102014002103 A2 * 3/2016 ..... E21B 33/12
BR 112015006548 B1 * 12/2020 ..... E21B 43/10
(Continued)

OTHER PUBLICATIONS

International Search Report and Written Opinion of International Application No. PCT/BR2019/050123, dated Jun. 28, 2019.

*Primary Examiner* — Daniel P Stephenson
(74) *Attorney, Agent, or Firm* — Raphael Bellum PLLC

(57) ABSTRACT

There is provided a method for well construction comprising the steps of: a first phase of the well construction, in which a bottom hole assembly, BHA, with a first drill is used for drilling, and a conductor casing is lowered into the well and cemented; a second phase of the well construction, in which a second drill is used for drilling, wherein a production adapter base, PAB, is installed in parallel with lowering a blowout preventer, BOP; and a third phase of the well construction in which a third drill is used for drilling, for the steps of landing and geonavigation inside a reservoir.

19 Claims, 2 Drawing Sheets

(51) Int. Cl.

| | |
|---|---|
| ***E21B 33/064*** | (2006.01) |
| ***E21B 33/14*** | (2006.01) |
| ***E21B 41/00*** | (2006.01) |
| ***E21B 7/00*** | (2006.01) |
| ***E21B 47/00*** | (2012.01) |

(52) U.S. Cl.
CPC ..... *E21B 23/06* (2013.01); *E21B 33/064* (2013.01); *E21B 33/14* (2013.01); *E21B 47/00* (2013.01)

(56) References Cited

U.S. PATENT DOCUMENTS

| | | | | |
|---|---|---|---|---|
| 2012/0199346 | A1* | 8/2012 | Patel | E21B 43/08 166/278 |
| 2014/0209327 | A1* | 7/2014 | Patel | E21B 33/12 166/387 |
| 2018/0230751 | A1* | 8/2018 | Noui-Mehidi | E21B 43/30 |
| 2018/0283735 | A1* | 10/2018 | Song | E21B 43/305 |
| 2021/0148195 | A1* | 5/2021 | Freire Grandi | E21B 7/00 |

FOREIGN PATENT DOCUMENTS

| | | | | |
|---|---|---|---|---|
| BR | 112020023801 | A2 * | 2/2021 | E21B 23/06 |
| CA | 3003706 | A1 * | 11/2019 | E21B 33/1216 |
| EP | 3580423 | B1 * | 11/2020 | E21B 33/04 |
| WO | 03/042488 | A2 | 5/2003 | |
| WO | 03/042489 | A2 | 5/2003 | |
| WO | WO-2015081398 | A1 * | 6/2015 | E21B 33/14 |

* cited by examiner

METHODS FOR WELL CONSTRUCTION AND COMPLETION

FIELD OF THE INVENTION

This application claims the benefit of priority to BR 10 2018 006864-4 filed 5 Apr. 2018, which is incorporated herein by reference in its entirety.

The present invention relates to methods for construction of oil wells. More particularly, the present disclosure relates to the construction of oil wells using slender well design, and can use fewer manoeuvres during construction and completion.

BACKGROUND OF THE INVENTION

In the prior art, a high proportion of shallow-water and deep-water oil wells are constructed according to a so-called slender design, which comprises four principal phases of installation, in which conductor, surface and production casings are lowered, before drilling the last phase, normally horizontal, for subsequent installation of a gravel pack.

In general, in phase 1 of the slender design, the start of the well may be drilled, blasted or based on using a torpedo, depending on the characteristics of the sea floor. In the case of a drilled well start, a BHA (bottom hole assembly) is used with a 36" drill, and a 30" conductor casing is lowered and cemented.

Phase 2 is usually drilled with a 17½" drill, with seawater and return to the seabed. Then the 13⅜" surface casing is lowered and cemented. The PAB (production adapter base) is installed by the SSV (subsea support vessel/subsea equipment support vessel) in an operation parallel with lowering of the BOP (blowout preventer) by the rig.

Next, phase 3 is drilled with a 12¼" drill with synthetic fluid, in a closed circuit, until landing the well at the top of the reservoir. Next, the 9⅝" production casing is then lowered and cemented.

Drilling of phase 4 is carried out with an 8½" drill using water-based fluid with a horizontal path navigating inside the reservoir. At the end of drilling, the well is conditioned and the drilling fluid is replaced with completion fluid.

It is possible to streamline the above process by combining the aforementioned steps 3 and 4 into a single step. Such a combination of steps is not observed in the known processes of the prior art.

After the 4 aforementioned phases of drilling are done, the completion phase is performed. The completion phase is divided into two stages, lower completion and upper completion, which will be described below.

Lower completion includes installation of the gravel pack for turbidite (turbidity) reservoirs. In the case of producing wells this operation consists of assembling and lowering the sand control screens (screened tubes), blank pipes (blind tubes), and modulated with Gravel Pack, with packer sealbore and formation isolating valve (FIV), besides the inner string of wash pipes. After positioning the screens at the bottom of the well, the packer is seated and gravel pumping (GPH) is carried out. In other words, once the screens are in place, the gravel in a carrier fluid can be pumped into the annular space between the screens and the well.

For injection wells, lower completion consists of assembling the same equipment as described above, but without the inner string of wash pipes, since there is no need to place propping agent in the annulus between the well and the screens, i.e. the well remains stand-alone (SAW). However, stimulation of the formation is required, and is carried out by acidizing via direct bullheading using ammonium chloride ($NH_4Cl$) as spacer.

For injection wells, it may still be preferable to carry out the injectivity test, if requested by the reservoir team.

At the end of the gravel, or acid, operations, the FIV is closed and tested, and the wear sleeve of the PAB is recovered.

The upper completion phase consists of assembling, lowering and installing the production or injection string (COP/COI) and laying the TH in the housing of the PAB in One and a Half Trip.

For the balancing manoeuvre, the string is assembled with anchor seal, DB nipple, TSRH, PDG, HFIV, string accessories (CIM and GLM for producing wells) and production tubes until close to the position of installation of the SSSD. All of these processes are familiar to a person skilled in the art, who will have no difficulty in reproducing the steps described.

The string is then lowered with drill pipes from the rig, the anchor is seated in the bore of the packer sealbore, the TSR is released and the balancing mark is made. The string is then withdrawn, balancing is carried out and the SSSD and TH are installed. The string is then lowered with 6⅝" drill pipes from the rig or DPR. The TSR is jacketed, the TH is seated and prevention of hydrates is carried out. At the end of the operation, the FIV is opened with pressure cycles and the well is delivered with the HFIV and the SSSD closed and tested for subsequent installation of the WCT at the end with SESV.

However, it would be very advantageous if the steps of upper and lower completion, described above, could also be carried out in a single manoeuvre, which would result in a great saving of working time, and would also result in a saving of resources.

Various studies concerning the potential for using wells of the slender type are known from the prior art, and the following may be mentioned in particular: Slender Well Drilling and Completion (Tangen, E. H.); Advancements in Slender Well Design (P. D. Howlett); and Case Study of New Slender Well Construction Technology (P. D. Howlett et al.).

However, none of the documents cited discloses a well design of the slender type where the steps of upper and lower completion are carried out in a single manoeuvre. Moreover, none of these documents discloses the possibility of condensing aforementioned phases 3 and 4 of well drilling into a single step.

As will be described in more detail hereunder, the present disclosure aims to solve the problems of the prior art described above in a practical and efficient manner.

SUMMARY OF THE INVENTION

The present disclosure provides a method for construction and completion of a well (of the slender type) comprising the aforementioned phases 3 and 4 condensed into a single step, as well as combining lower and upper completion stages into a single manoeuvre.

According to the disclosure, a method for well construction and completion is provided, comprising at least one of the steps of: a first phase of well construction, in which a BHA is used with a first drill. A conductor casing may be lowered and cemented after drilling in this first stage; a second phase of the well construction, in which a second drill is used for drilling, and in which, in parallel with lowering a BOP, a PAB is installed; a third phase of well construction, in which a third drill is used for drilling. The drilling in the third phase comprises both landing and geonavigation inside the reservoir. Alternatively, the first phase of well construction may comprise blasting or use of a torpedo.

Optionally, the first phase of well construction may comprise blasting or use of a torpedo. In some embodiments, the first phase of well construction may comprise blasting or use of a torpedo without drilling.

Optionally, during the second phase of well construction, seawater is used as a drilling fluid with return to the seabed.

Optionally, during the third phase of well construction, synthetic or water-based fluid is used as the drilling fluid in a closed circuit.

Optionally, following the third phase of well construction, the steps of conditioning the well and replacing the drilling fluid with completion fluid is performed.

Optionally, following the third phase of well construction, the step of carrying out lower and upper completion of the well in a single manoeuvre is performed.

Optionally, the first drill diameter is greater than the second drill diameter.

Optionally, the second drill diameter is greater than the third drill diameter.

Optionally, after the third phase of well construction, the well is conditioned, and the drilling fluid is replaced with completion fluid.

Optionally, after the step of the third phase of well construction, the lower and upper completion of the well is carried out in a single manoeuvre.

According to another aspect of the disclosure, there is provided a method for performing upper and lower completion of a well in a single manoeuvre.

Optionally, the step of lower and upper completion in a single manoeuvre comprises carrying out sand control by using a stand-alone technique.

Optionally, the step of lower and upper completion in a single manoeuvre comprises carrying out sand control by the gravel pumping (GPH) technique.

Optionally, the step of lower and upper completion in a single manoeuvre comprises installing at least one component from a first group of: hydraulic screens; formation isolating valve FIV; or blind tubes; and installing at least one component from a second group of: mechanical annular barrier, MAB; packer of the cut to release type; tubing seal receptacle, TSR hydraulic; string accessories; hydraulic formation isolating valve, HFIV; production tubes; subsurface safety device, SSSD; string hanger; and tubing hanger TH.

Optionally, after the steps of installing at least one component from the first group, and one component from the second group, an assembly with drill pipes is lowered to the bottom of the well.

Optionally, after the steps of installing at least one component from the first group, and one component from the second group, at least one of the following steps is performed:

a. actuating the hydraulic screens;
b. closing the FIV;
c. seating the packer against the FIV;
d. seating the MAB against the FIV;
e. releasing the TSR hydraulic against the FIV;
f. seating and testing the TH;
g. opening the FIV with pressure cycles;
h. acidizing the formation;
i. taking action to prevent hydrates;
j. closing the HFIV;
k. closing the SSSD; and
l. installing a wet Christmas tree, WCT.

According to another aspect of the disclosure, there is provided a method for well construction comprising at least one of the steps of: a first phase of the well construction, comprising blasting or use of a torpedo, and a conductor casing is lowered into the well and cemented; a second phase of the well construction, in which a drill is used for drilling, wherein a production adapter base, PAB, is installed in parallel with lowering a blowout preventer, BOP; and a third phase of the well construction in which a drill is used for drilling, for the steps of landing and geonavigation inside a reservoir.

According to another aspect of the disclosure, there is provided a well, constructed according to at least one of the following steps: a first phase, in which a bottom hole assembly (BHA) with a drill of a first diameter is used for drilling, and a conductor casing is lowered into the well and cemented; a second phase, in which a drill of a second diameter is used for drilling, wherein a production adapter base (PAB) is installed in parallel with lowering a blowout preventer (BOP); and a third phase in which a drill of a third diameter is used for drilling, for the steps of landing and geonavigation inside a reservoir.

According to another aspect of the disclosure, there is provided a well, constructed according to at least one the following steps: a first phase, comprising blasting or use of a torpedo, and a conductor casing is lowered into the well and cemented; a second phase, in which a drill is used for drilling, wherein a production adapter base, PAB, is installed in parallel with lowering a blowout preventer, BOP; and a third phase in which a drill is used for drilling, for landing and geonavigation inside a reservoir.

According to another aspect of the disclosure, there is provided a well, completed according to a completion process, wherein completion is performed in a single manoeuvre.

In order to achieve the aim described above, there is also disclosed a method for well construction and completion comprising the steps of: drilling phase 1 of the well, in which a BHA is used with a 36" drill, and a 30" conductor casing is lowered and cemented; drilling phase 2 of the well with a 12¼" or 14¾" drill, in which seawater is used with return to the seabed, and in which, in parallel with lowering a BOP, a PAB is installed; drilling phase 3 with an 8½" or 9½" drill using synthetic or water-based fluid, in a closed circuit, in which a shale section is drilled until landing and geonavigation inside the reservoir; conditioning the well and replacing the drilling fluid with completion fluid; and carrying out lower and upper completion of the well in a single manoeuvre.

It can be seen that the steps described by the aforementioned embodiment allow for well construction in only three drilling stages, as opposed to the four stages used in the prior art. By reducing the number of drilling stages, the well construction process is simplified. Removing a drilling stage means the drill string does not need to be returned to the surface to change the drill bit, and the drilling fluid supply does not need to be changed over. Such simplification of the process reduces the time and costs associated with well construction.

Separate steps 3 and 4 in prior art conventional well construction provide structural integrity to the wellbore. The present disclosure conserves this structural integrity despite the combination of steps 3 and 4 through the aforementioned features of the embodiments. Separate steps 3 and 4 in prior art conventional well construction also serve different functions; step 3 lands the wellbore at the reservoir, and step 4 begins the horizontal drilling process. However, the aforementioned embodiments of the disclosure are able to perform both functions in a third drilling phase via geonavigation of the drill bit and the selection of the aforementioned features of the embodiments.

There is also disclosed a method for well construction and completion comprising the steps of: drilling phase 1 of the well, in which a BHA with a 36" drill is used, and a 30" conductor casing is lowered and cemented; drilling phase 2 of the well with a 12¼" or 14¾" drill, in which seawater is used with return to the seabed, and in which, in parallel with lowering a BOP, a PAB (3) is installed; the method being characterized in that it additionally comprises the steps of: drilling phase 3 of the well with an 8½" or 9½" drill using synthetic or water-based fluid, in a closed circuit, in which a shale section is drilled until landing and geonavigation inside the reservoir; conditioning the well and replacing the drilling fluid with completion fluid; and carrying out lower and upper completion of the well in a single manoeuvre.

Optionally, in the step of drilling phase 1 of the well, the drilling process may be blasting or based on use of a torpedo.

Optionally, in the step of lower and upper completion in a single manoeuvre comprises carrying out sand control by the stand alone technique.

Optionally, the step of lower and upper completion in a single manoeuvre comprises carrying out sand control by the GPH technique.

Optionally, the step of lower and upper completion in a single manoeuvre comprises at least one step among:

installing at least one of: hydraulic screens; FIV (12), blind tubes; MBA (11); packer (10) of the cut to release type; TSR hydraulic (8); string accessories; HFIV valve (6); production tubes (4); SSSD (2) and string hanger;

lowering an assembly with 6⅝" drill pipes or DPR to the bottom of the well;

performing at least one of the following steps: actuating the hydraulic screens (13); closing the FIV (12); seating the packer against the FIV (12); seating the MBA (11) against the FIV (12); releasing the TSRH (8) against the FIV (12); seating and testing the TH (14); opening the FIV (12) with pressure cycles; acidizing the formation; taking action to prevent hydrates; closing the HFIV (6); closing the SSSD (2); and installing the WCT (1).

BRIEF DESCRIPTION OF THE FIGURES

The detailed description presented hereunder refers to the figures and their respective reference numbers.

DETAILED DESCRIPTION OF THE INVENTION

Firstly, it is emphasized that the description given hereunder is based on a preferred embodiment of the disclosure. As will be obvious to a person skilled in the art, however, the disclosure is not limited to this particular embodiment.

In addition, it is also important to point out that many elements used by the method described below will be described by their abbreviations, which are familiar to a person skilled in the art. This option is adopted with the aim of simplifying the description.

Figure 1:
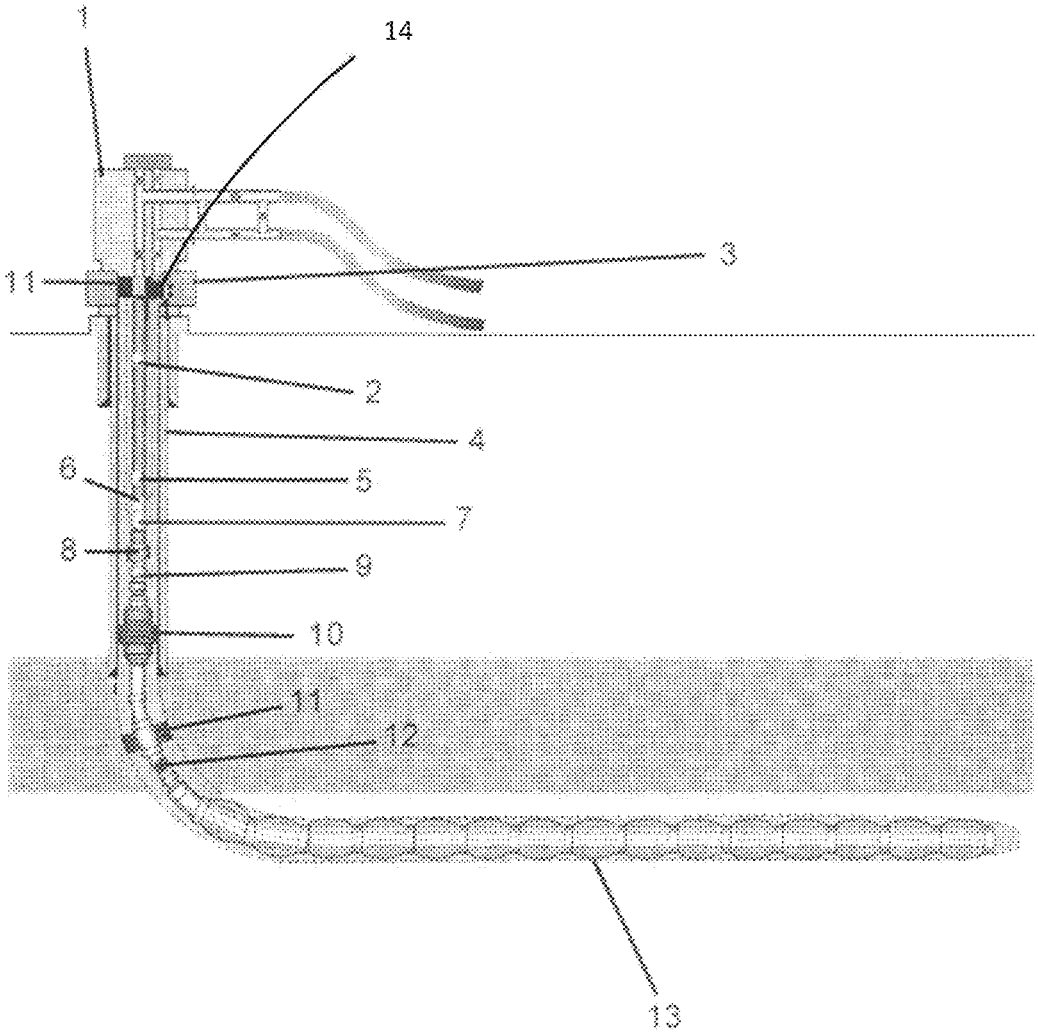
FIG. 1 shows a schematic diagram of a design of well installed in accordance with the method of the present disclosure.

FIG. 1 shows a schematic diagram of a design of well installed in accordance with the method of the present disclosure. The following description of the embodiments refer to this FIGURE.

Relative to the known processes of the prior art, the main advantage of the design of the present disclosure is that it eliminates one drilling phase. This is achieved by executing landing and drilling of the horizontal phase in the reservoir (phases 3 and 4 of the slender design, described above) in a single phase. As previously described, the combination of landing and horizontal drilling are achieved in the disclosure by geonavigation of the drill bit and control of drilling fluids. Furthermore, lower completion and upper completion can be performed in a single manoeuvre, increasing the efficiency of the method of the present disclosure.

Figure 2:
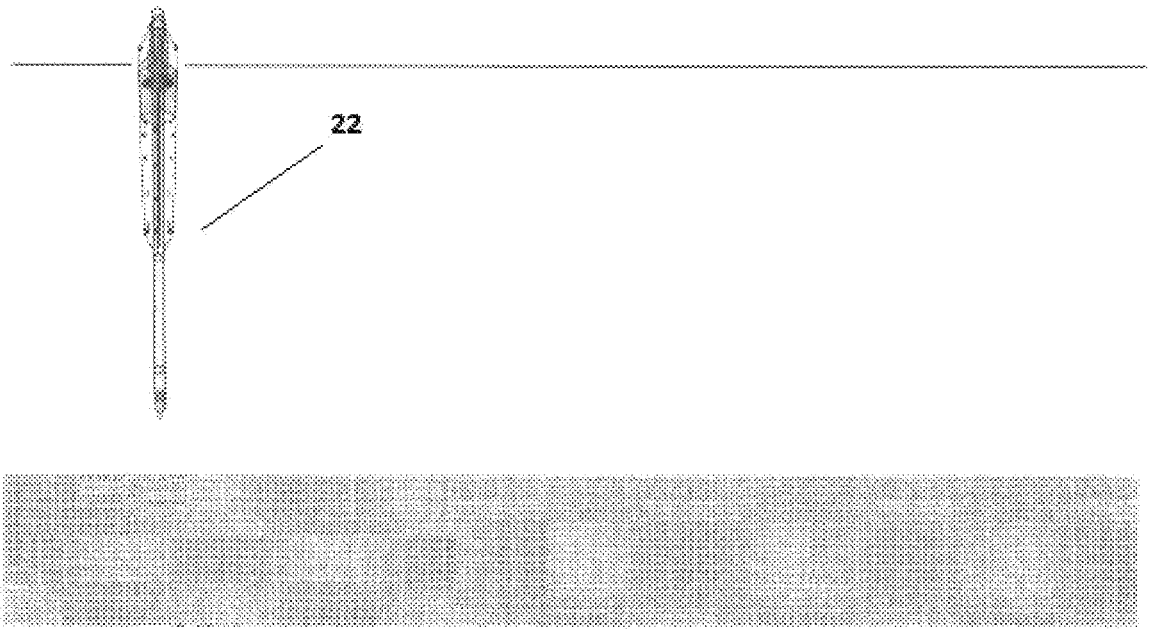
FIG. 2 shows a schematic diagram of a design of a well constructed in accordance with the method of the present disclosure using blasting or use of a torpedo.

The method for well construction and completion of the present disclosure comprises a first phase, in which a BHA (Bottom Hole Assembly) is used with a drill of a first diameter. A conductor casing may be lowered and cemented. Optionally, in this step, the drilling process may comprise blasting or be torpedo-based, as shown in FIG. 2, depending on the characteristics of the sea floor. The first phase of well construction may comprise blasting or use of a torpedo 22 without drilling.

Optionally, the first drill diameter is 36".

Optionally, the diameter of said conductor casing in the first drilling phase is 30".

Next, a second phase of well construction comprises drilling with a drill of a second diameter. Seawater may be used as the drilling fluid with return to the seabed. In this step, drilling may be performed to a greater depth than in the conventional slender design, ending the phase close to (at a safe distance from) the top of the reservoir. By contrast, prior art methods end the second drilling phase very far from the reservoir.

Optionally, the second drill diameter is the same as the first drill diameter. Alternatively, the second drill diameter may be smaller than the first drill diameter. Optionally, the second drill diameter is 12¼" or 14¾".

In addition, in this second phase, a production casing may be lowered and cemented. The second phase amy also include installing and testing the BOP (Blow Out Preventer), and installing a PAB 3 (Production Adapter Base) with the SESV (Subsea Equipment Support Vessel).

Optionally, the diameter of said production casing in the second phase is 9⅝" or 10¾".

Next, the third phase of well construction comprises drilling with a drill of a third diameter. A synthetic or water-based fluid may be used as the drilling fluid in a closed circuit. A shale section may be drilled in this third phase. Drilling is continued for landing and for geonavigation of the drill inside the reservoir. This geonaviagation step may comprise inclined or horizontal drilling. At the end of this drilling step, the well is conditioned and the drilling fluid is replaced with completion fluid.

Optionally, the third drill diameter smaller than the second drill diameter. The third drill diameter may be 8½" or 9½". The third drill diameter may be equivalent to that used in "phase 4" of a conventional "slender" well design. This maintains the manoeuvrability of the drill during the geonavigation stage, and it has been surprisingly identified that such a drill size may also be used during the landing stage, thus enabling one drilling phase to be used for both of those steps.

Finally, more generally, the steps of carrying out lower and upper completion of the well is performed. These steps can be performed in a single manoeuvre.

For this design of completion in a single manoeuvre, the sand control technique adopted may be stand-alone, which complies with the guidelines that are usually adopted. For producing wells, the type of sand control indicated for horizontal wells may be GPH (gravel pumping).

With the aim of minimizing the impact of not using the propping agent, reducing the annular space, and minimizing the movement of fines, a hydraulic screen may be used. This hydraulic screen may extend up to the wall of the well.

Optionally, for injection wells, the step of lower and upper completion in a single manoeuvre may comprise the steps of installing one or more of: Premium 13 screens, FIV 12 (formation isolating valve), blind tubes, MAB 11 (mechanical annular barrier, or mechanical barrier of annulus), string packer 10 of the cut to release type, TSRH 8 (Tubing Seal Receptacle Hydraulic or telescopic seal), string accessories, such as PDG 7 (Pressure Downhole Gauge), valve HFIV 6 (Hydraulic Formation Isolating Valve), production tubes 4, SSSD 2 (Sub Surface Safety Device) and TH 14 (Tubing Hanger or string suspender).

Optionally, for producing wells, the step of lower and upper completion in a single manoeuvre may comprise the steps of installing one or more of: hydraulic screens, FIV 12 (formation isolating valve), blind tubes, MAB 11 (mechanical barrier of annulus), string packer 10 of the cut to release type, TSRH 8 (Tubing Seal Receptacle Hydraulic or telescopic seal), string accessories, such as PDG 7 (Pressure Downhole Gauge), CIM (Chemical Injection Mandrel), and GLM 5 (Gas Lift Mandrel), HFIV valve 6 (Hydraulic Formation Isolating Valve), production tubes 4, SSSD 2 (Sub Surface Safety Device) and TH 14 (Tubing Hanger or string suspender).

Thus, to summarize, the step of lower and upper completion in a single manoeuvre may comprise at least one step among:

installing at least one component from a first group of conventionally lower-completion components: hydraulic screens; formation isolating valve FIV; or blind tubes; and installing at least one component from a second group of conventionally upper-completion components: mechanical annular barrier, MAB; packer of the cut to release type; tubing seal receptacle, TSR hydraulic; string accessories; hydraulic formation isolating valve, HFIV; production tubes; subsurface safety device, SSSD; string hanger; and tubing hanger TH.

lowering the assembly with 6⅝" drill pipes or DPR (Drill Pipe Riser) to the bottom of the well;

actuating the hydraulic screens 13;

closing FIV 12 (formation isolating valve);

seating packer 10 against FIV 12 (formation isolating valve);

seating MAB 11 (mechanical barrier of annulus) against FIV 12 (formation isolating valve);

releasing TSRH 8 (Tubing Seal Receptacle hydraulic) against FIV 12 (formation isolating valve);

seating and testing TH 14;

opening FIV 12 (formation isolating valve) with pressure cycles;

acidizing the formation (in the case of injection wells);

taking action to prevent hydrates;

closing HFIV 6 (Hydraulic Formation Isolating Valve);

closing SSSD 2 (Sub Surface Safety Device); and installing WCT 1 (Wet Christmas Tree) with SESV (Subsea Equipment Support vessel).

In other words, completion in a single manoeuvre can include installing upper and lower completion components on the string, such that said string can perform the installation and actuation steps of upper and lower completion in a single manoeuvre. Namely, the string assembly containing the upper and lower completion components is only lowered into the well once. The string assembly does not need to be withdrawn between the conventional steps of upper completion and lower completion.

It may be pointed out that the method of designing a well now described may be applied in directional or horizontal producing or injection wells in sandstone reservoirs.

In the case of carbonate reservoirs, the technique may also be applicable for producing wells and injection wells. However, in this case, it is preferable to replace the sand control screens 13 with a perforated liner. Of course, a person skilled in the art will have no difficulty in carrying out this replacement in the case of this specific application.

Numerous variations falling within the scope of protection of the present application are permitted. This reinforces the fact that the present invention is not limited to the particular configurations/embodiments described above. Modifications of the above-described apparatuses and methods, combinations between different variations as practicable, and variations of aspects of the invention that are obvious to those of skill in the art are intended to be within the scope of the claims.

The invention claimed is:

1. A method for well construction comprising the steps of:

a first phase of the well construction, in which a bottom hole assembly, with a first drill is used for drilling, and a conductor casing is lowered into a well and cemented;

a second phase of the well construction, in which a second drill is used for drilling, wherein a production adapter base is installed and lowering a blowout preventer at substantially the same time as the installation of the production adapter base; and a third phase of the well construction in which a third drill is used for drilling, including landing and geonavigation inside a reservoir.

2. The method according to claim 1, wherein the drilling of the first phase of the well construction further comprises:

blasting or using a torpedo to open the well.

3. The method according to claim 1, wherein the second phase of well construction further comprises:

drilling with seawater as a drilling fluid of the second drill; and returning the seawater to a seabed.

4. The method according to claim 1, wherein the third phase of well construction further comprises:

drilling with synthetic or water-based fluid as a drilling fluid of the third drill in a closed circuit.

5. The method of according to claim 1, wherein a diameter of the first drill is greater than a diameter of the second drill.

6. The method according to claim 1, wherein a diameter of the second drill is greater than a diameter of the third drill.

7. The method according to claim 1, wherein after the third phase of well construction, the method further includes:

conditioning the well, and replacing a drilling fluid with completion fluid.

8. The method according to claim 1 further comprising:

performing a lower and upper completion of the well in a single maneuver.

9. The method according to claim 8, wherein the performing of the lower and upper completion in the single maneuver comprises:

carrying out sand control using a stand-alone technique.

10. The method according to claim 8, wherein the performing of the lower and upper completion in the single maneuver comprises:

carrying out sand control by a gravel pumping technique.

11. The method according to claim 8, wherein the performing of the lower and upper completion in the single maneuver comprises:

installing at least one component selected from a first group consisting of: a hydraulic screen; a formation isolating valve; or a blind tube; and installing at least one component selected from a second group consisting of: a mechanical annular barrier; a cut-to-release type of packer; a tubing seal receptacle-hydraulic; string accessories; a hydraulic formation isolating valve; a production tube; a subsurface safety device; a string hanger; and a tubing hanger.

12. The method according to claim 11 further comprising:

lowering an assembly with drill pipes to a bottom of the well after installing the at least one component from the first group, and the at least one component from the second group.

13. The method according to claim 11, wherein at least one of the following steps is performed after the at least one component from the first group, and the at least one component from the second group are installed:

actuating the hydraulic screen;

closing the formation isolating valve;

seating the packer against the formation isolating valve;

seating the MAB against the formation isolating valve;

releasing the TSR hydraulic against the formation isolating valve;

seating and testing the tubing hanger;

opening the formation isolating valve with pressure cycles;

acidizing the formation;

taking action to prevent hydrates;

closing the hydraulic formation isolating valve;

closing the subsurface safety device; and installing a wet Christmas tree.

14. A method for well construction comprising the steps of:

a first phase of the well construction, comprising:

blasting or using a torpedo to open a well, and lowering a conductor casing into the well, and cementing the conductor casing;

a second phase of the well construction comprising:

drilling, and installing a production adapter base and lowering a blowout preventer at substantially the same time as the installation of the production adapter base; and a third phase of the well construction comprising drilling with a third drill for landing and geonavigation inside a reservoir.

15. The method according to claim 14 further comprising:

performing a lower and upper completion in a single maneuver.

16. A well, constructed according to the following steps:

a first phase, in which a bottom hole assembly, with a first drill is used for drilling, and a conductor casing is lowered into the well and cemented;

a second phase, in which a second drill is used for drilling, wherein a production adapter base is installed and lowering a blowout preventer at substantially the same time as the installation of the production adapter base; and a third phase in which a third drill is used for drilling, for landing and geonavigation inside a reservoir.

17. The well according to claim 16 completed according to a completion process comprising:

performing an upper and lower completion in a single maneuver.

18. A well, constructed according to the following steps:

a first phase, comprising blasting or using a torpedo, and a conductor casing is lowered into the well and cemented;

a second phase, in which a drill is used for drilling, wherein a production adapter base is installed and lowering a blowout preventer at substantially the same time as the installation of the production adapter base; and a third phase in which a drill is used for drilling, for landing and geonavigation inside a reservoir.

19. The well according to claim 18 completed according to a completion process comprising:

performing an upper and lower completion in a single maneuver.

* * * * *